US007431750B2

(12) United States Patent
Liao et al.

(10) Patent No.: US 7,431,750 B2
(45) Date of Patent: Oct. 7, 2008

(54) NANOSTRUCTURED METAL POWDER AND METHOD OF FABRICATING THE SAME

(75) Inventors: Shih-Chieh Liao, Taoyuan (TW); Jin-Ming Chen, Taoyuan (TW); Song-Wein Hong, Changhua (TW); Zhong-Ren Wu, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 329 days.

(21) Appl. No.: 11/321,615

(22) Filed: Dec. 28, 2005

(65) Prior Publication Data

US 2006/0162495 A1 Jul. 27, 2006

Related U.S. Application Data

(62) Division of application No. 10/457,957, filed on Jun. 10, 2003, now abandoned.

(30) Foreign Application Priority Data

Dec. 27, 2002 (TW) ..... 91137652 A

(51) Int. Cl.
*B22F 9/14* (2006.01)

(52) U.S. Cl. ..... 75/336; 75/346

(58) Field of Classification Search ..... 75/336, 75/338

See application file for complete search history.

(56) References Cited

U.S. PATENT DOCUMENTS 5,294,242 A * 3/1994 Zurecki et al. ..... 75/345
5,935,461 A * 8/1999 Witherspoon et al. .. 219/121.59
6,398,125 B1 * 6/2002 Liu et al. ..... 239/13

* cited by examiner

*Primary Examiner*—George Wyszomierski
(74) *Attorney, Agent, or Firm*—Quintero Law Office

(57) ABSTRACT

The present invention relates to a nanostructured metal powder and a method of fabricating the same. A twin-wire electric arc process is performed to melt the wire tips, and metal melt is formed. Simultaneously, the metal melt is broken up into melt droplets by an atomizing device. The operating temperature of the electric arc process is controlled between melting point and boiling point of the wire, to avoid vaporization of the melt droplets. Then, a fast cooling is performed to quench the melt droplets. Thus, melt droplets are solidified to μm-scaled, spherical and dense powders comprising nano-grains (d<100 nm).

8 Claims, 3 Drawing Sheets

NANOSTRUCTURED METAL POWDER AND METHOD OF FABRICATING THE SAME

This application is a divisional of U.S. application Ser. No. 10/457,957, filed Jun. 10, 2003.

BACKGROUND OF THE INVENTION

1. Field of the Invention

The present invention relates to a metal powder structure and a method of fabricating the same, and more particularly, to a nanostructured metal powder comprising a plurality of nano-grains and a method of fabricating the same.

2. Description of the Related Art

The interest in nanometer-sized (nano-) particles or clusters is due to their unique and improved properties. Nano-particles have enormous potential in metal and ceramic processing. For example, nano-particles can be sintered at much lower temperature (<0.5 $T_m$; $T_m$=melting temperature). In addition, the mechanical, electronic, optical, magnetic and thermal properties of nano-crystalline materials are different from those exhibited by their conventional counterparts. Their unique physical and chemical properties have created considerable enthusiasm for nanotechnology development.

U.S. Pat. No. 4,610,718 discloses a method for manufacturing ultra-fine particles. In the conventional method, arcs are struck across an electrode and a metal material serving as another electrode, thereby vaporizing the metal material into ultra-fine particles (also referred to as metal nano-powders with average diameter about 1~100 nm). Nevertheless, the metal nano-powders are very active due to their relatively large surface area. Employing the metal nano-powders in battery application, for example, could be very dangerous, sometimes could even result in explosion, since the unstable metal nano-powders would cause violently chemical reaction with oxygen or electrolytes. In addition, the much greater surface area of the metal nano-powders causes poor fluidity and dispersion for electrode slurries.

In order to solve the above problems, a passivation treatment can be performed on the surface of the metal nano-powders. For example, the surface of the metal nano-powders may be coated with an organic thin film. However, this method not only seriously decreases the mass transfer rate and electrical conductivity of the metal nano-powders but increases manufacturing costs.

Another method for solving the above problems is employing granulation (or particle making) process to obtain larger particles (μm-scaled particle). However, the conventional granulation method suffers from problems such as difficultly in controlling particle morphology, internal void defects, and hollowness issues. These seriously affect material and thus device performances. Also, the process increases manufacturing costs as well.

Thus, considering the performance, safety and convenient utilization, a novel metal powder structure and a method of fabricating the same are brought out in the present invention.

SUMMARY OF THE INVENTION

The object of the present invention is to provide a μm-scaled, spherical and dense metal (and alloy) powders comprising nano-grains (d<100 nm), and a method of fabricating the same.

The method of fabricating metal powders with the above-mentioned structure is described as follows. The feedstock used in the present invention is metal in the form of wires. A twin-wire electric arc process using the wires as electrodes is performed to melt the wire tips to form a metal melt, and simultaneously, the metal melt is broken up into melt droplets by an atomizing device, wherein an operating temperature of the electric arc process is controlled between melting point and boiling point of the wire, to avoid vaporization of the melt droplets. A quenching process is then performed to cool the melt droplets by means of a cooling medium.

According to the present method, a nanostructured metal powder, that is, a μm-scaled, spherical and dense powder structure comprising nano-grains (d<100 nm), is obtained.

The present invention improves on the prior art in that the operating temperature of the electric arc process is controlled between melting point and boiling point of the wire, to avoid vaporization of the melt droplets, and a quenching process is performed to cool the melt droplets by means of a cooling medium. Thus, a nanostructured metal powder comprising nano-grains (d<100 nm) is obtained. In comparison with conventional μm-scaled metal powder, surface area of the nanostructured metal powder of the present invention is not increased and therefore the powder is stable and safe. The nanostructured metal powder of the present invention is spherical, thereby improving fluidity and packing density thereof. In addition, grain boundary area in the nanostructured metal powder is very great, thereby increasing diffusion and mass transfer rate thereof. Thus, the nanostructured metal powder can be applied to hydrogen storage and battery electrode materials.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE INVENTION

Figure 1:
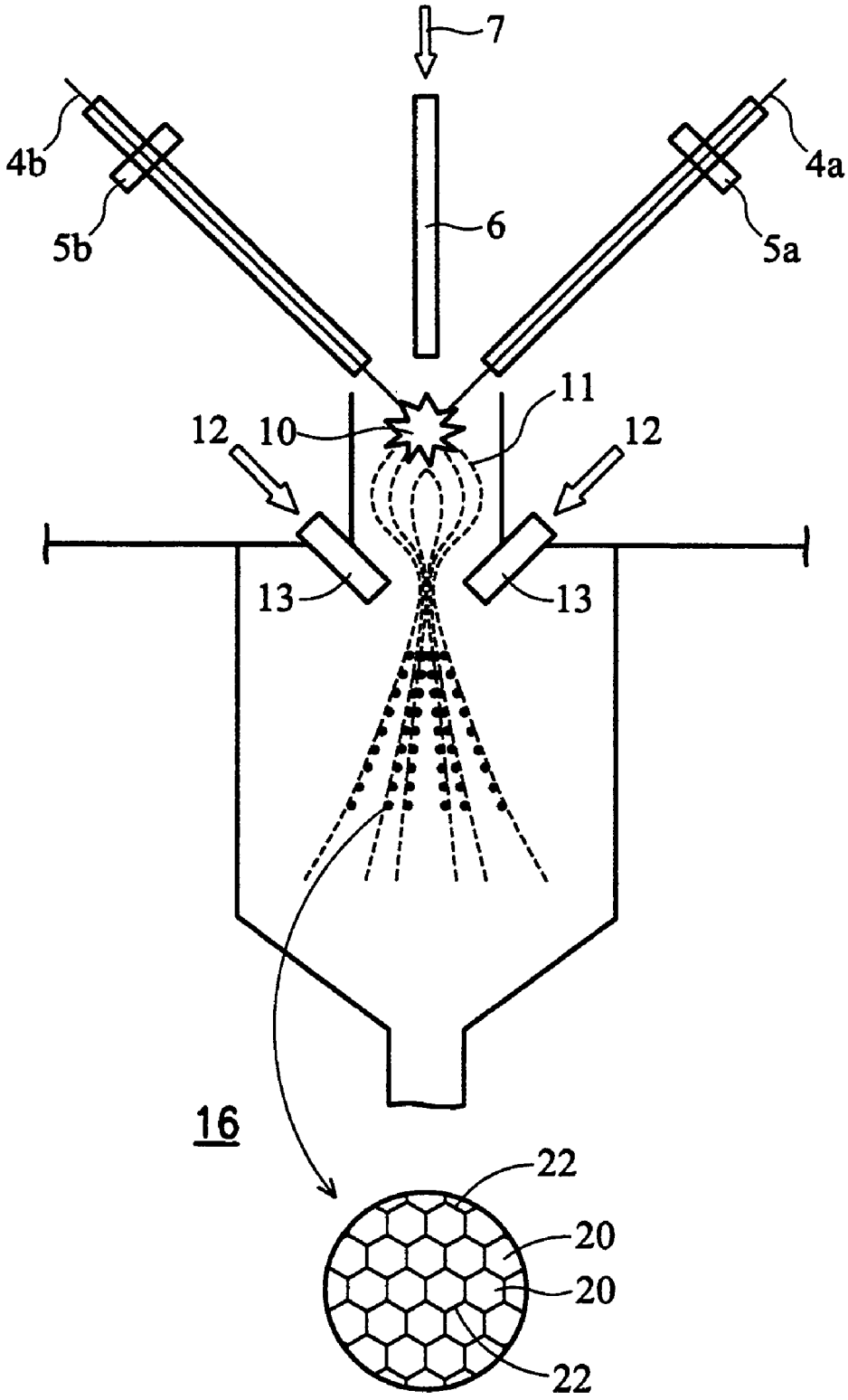
FIG. 1 schematically shows a preferred embodiment of an apparatus for producing nanostructured metal powders of the present invention, and a diagram of the nanostructured metal powder.

FIG. 1 schematically shows an apparatus using a twin-wire electric arc process, in accordance with a preferred embodiment, for producing nanostructured metal powders of the present invention. FIG. 1 also shows a structural diagram of the nanostructured metal powder of the present invention.

In FIG. 1, in protective atmosphere, for example, in argon atmosphere at room temperature and 1 atm., two metal wires 4*a*, 4*b* serving as electrodes are fed through a wire-feeding device such as powered rollers 5*a*, 5*b* into the arc chamber continuously or intermittently on demand, and are supplied with a DC voltage (one "+" and the other "−") to form an arc 10 in an arc chamber. The two wires 4*a*, 4*b* and the desired metal powder 16 are the same material. This arc 10, having high temperature, melts the wire tips (tips of the wires 4*a*, 4*b*) to form a metal melt (molten metal), and simultaneously, the metal melt is broken up into melt droplets 11 by an atomizing device 6. For example, a pressurized stream of atomizing/carrier inert gas 7, such as Ar or He gas with 15~75 psi, may pass through the atomizing device 6 into the arc chamber to atomize the metal melt (breaking the metal melt into metal liquid droplets) to the melt droplets 11. The above process is referred to as a twin-wire electric arc process. It is important to note that the arc 10 temperature is controlled between melting point and boiling point of the wire (4*a*/4*b*), to avoid vaporization of the melt droplets 11.

In FIG. 1, a quenching process is then performed to quickly cool the melt droplets 11 to obtain the nanostructured powders 16 of the present invention. For example, a cooling medium 12, such as cool inert gas, liquid nitrogen, or cool water, is utilized to rapidly quench the melt droplets 11 to form the nanostructured powders 16. In this embodiment, cool inert gas 12 passes through a cyclonic device 13 to impinge upon the atomized metal droplets 11. Thus, the melt droplets 11 are solidified to the nanostructured powders 16.

It should be noted that each nanostructured powder 16 of the present invention comprises, referring to FIG. 1, a plurality of nano-grains 20 (average diameter of the nano-grains 20 is smaller than 100 nm) and continuous grain boundaries 22 formed among the nano-grains 20. The nanostructured metal powder 16 is spherical, and an average diameter of the nanostructured metal powder is μm-scaled (about 1~500 μm). In addition, the nanostructured metal powder 16 is a dense and polycrystalline structure.

As an applicable example of the present invention, the present invention can be applied to fabricate the nanostructured powders of Pd (palladium), without intending to limit the present invention. This example illustrates a method of forming Pd metal powders and the structure analysis thereof.

As shown in FIG. 1, a twin-Pd wire electric arc process is performed. Two Pd wires 4*a*, 4*b* that are 1.5 mm in diameter and serve as electrodes are fed trough a wire-feeding device 5*a*/5*b* and are supplied with power (one "+" and the other "−") to form an arc 10 for melting the Pd wire tips to form Pd melt (molten Pd). Simultaneously, the Pd melt is broken up into Pd melt droplets 11 by an atomizing device 6 using Ar gas of about 20 psi. The operating conditions of the supplied power are 30 DC Voltage and 120 Ampere. Thus, the arc 10 temperature is controlled between melting point (1554° C.) and boiling point (2800° C.) of the Pd wire (4*a*/4*b*), to avoid vaporization of the Pd melt droplets 11. The wire-feeding device 5*a*, 5*b*, such as powered rollers, can be set at a feed rate of 8 cm/sec. Thus, the two Pd wires 4*a*, 4*b* can be continuously fed through into the arc chamber, thereby forming about 6~8 kg/hr of nanostructured Pd powders after subsequent process.

Next, a quenching process is performed to cool the Pd melt droplets 11 by means of a cooling medium to facilitate solidification of the melt droplets 11 for forming nanostructured Pd powders 16. For example, the Pd melt droplets 11 are quenched by cool water of 15° C., thereby forming the nanostructured Pd powders 16.

Figure 2:
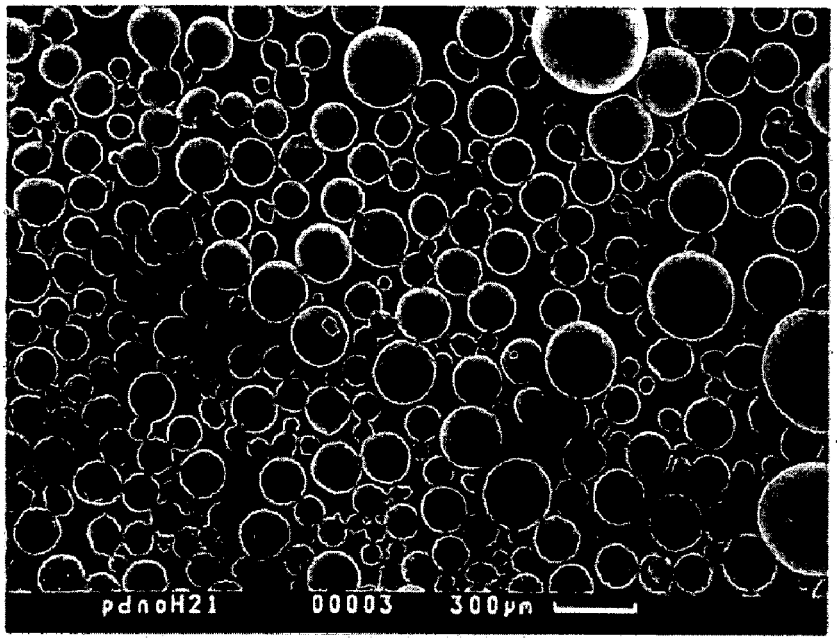
FIG. 2 is a SEM (Scanning Electron Microscopy) picture of the nanostructured metal powder according to the present invention.

FIG. 2 shows a SEM (Scanning Electron Microscopy) picture of the nanostructured Pd powders according to the present invention. In the SEM picture, the nanostructured Pd powders 16 formed by the above method are regularly spherical. The average diameter of the nanostructured Pd powders 16 is about 150 μm.

Figure 3:
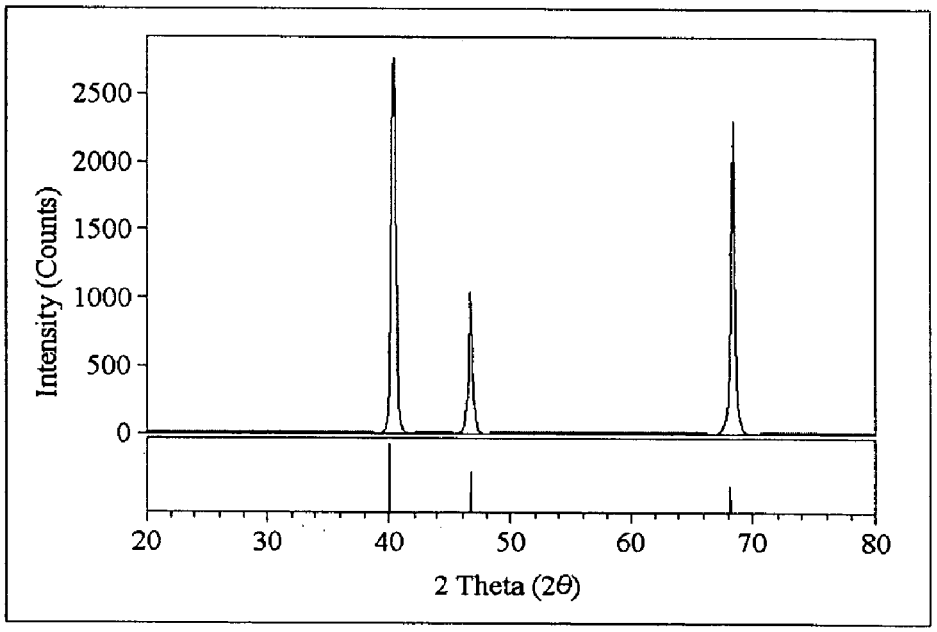
FIG. 3 is an XRD (X-ray diffraction) pattern of the nanostructured metal powder according to the present invention.

FIG. 3 shows an XRD (x-ray diffraction) pattern of the nanostructured Pd powders according to the present invention. Using Williamson and Hall method to analyze the broadening of XRD peaks, the average diameter of the nano-grains 20 within the nanostructured Pd powder 16 is determined to be about 70 nm.

Figure 4A:
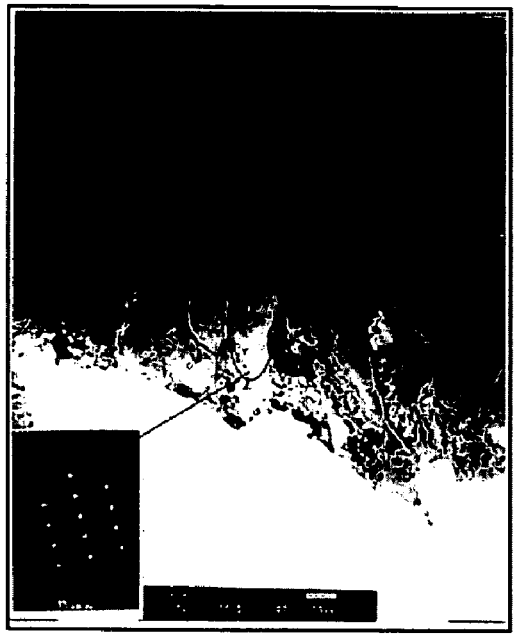
FIGS. 4*a* and 4*b* are TEM (Transmission Electron Microscopy) pictures of the nanostructured metal powder according to the present invention, wherein the corresponding electron diffraction pattern is inserted into each TEM picture.
Figure 4B:
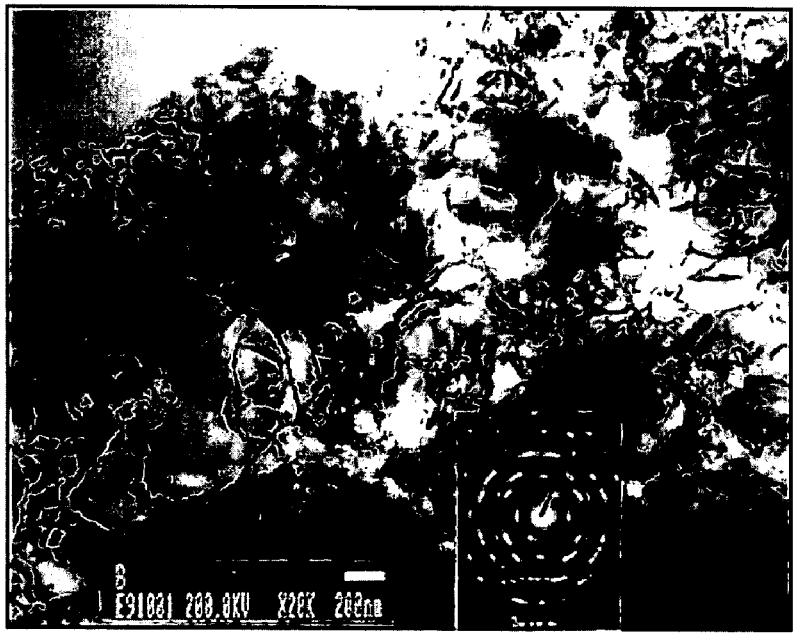

FIGS. 4*a* and 4*b* show TEM (Transmission Electron Microscopy) pictures of the nanostructured metal powder according to the present invention. According to the TEM pictures, the nanostructured Pd powder 16 comprising a plurality of nano-grains 20 and grain boundaries 22 formed among the nano-grains 20 is verified. Also, no pore or void defects can be observed in the powder 16. Thus, the nanostructured Pd powder 16 of the present invention is a dense and polycrystalline structure.

The electron diffraction pattern inserted in FIG. 4*a* verifies that each nano-grain 20 is a single-crystalline structure in the nanostructured Pd powder. Likewise, an electron diffraction pattern inserted in FIG. 4*b* verifies that the nanostructured Pd powder 16 is a polycrystalline structure, comprises a plurality of nano-grains.

The present invention improves on the prior art in that the operating temperature of the electric arc process is controlled between melting point and boiling point of the wire, to avoid vaporization of the melt droplets, and a quenching process is performed to cool the melt droplets by means of a cooling medium. Thus, a μm-sized metal powder comprising nano-grains (d<100 nm) is obtained. In comparison with conventional μm-scaled metal powder, the surface area of the nanostructured metal powder of the present invention is not increased and therefore the powder is stable and safe. The nanostructured metal powder of the present invention is spherical, thereby improving fluidity and packing density thereof. In addition, large grain-boundary area in the nanostructured metal powder increases diffusion and mass transfer rate thereof. Thus, the nanostructured metal powder can be applied to hydrogen storage and battery electrode materials. For example, when the invention is applied to hydrogen storage system, hydrogen absorption/desorption efficiency can be improved since diffusion rate is increased. Similarly, when the invention is applied to electrode material of Ni—H or Li battery, charging/discharging rate can be improved and yet operational safety of the battery is assured.

Finally, while the invention has been described by way of example and in terms of the above, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of fabricating a metal powder, comprising the steps of:

using metal wire as feedstock;

using two wires as electrodes;

performing a twin-wire electric arc process to melt the wire tips to form a metal melt, and simultaneously, breaking the metal melt into melt droplets by an atomizing device, wherein an operating temperature of the electric arc process is controlled between melting point and boiling point of the wire, to avoid vaporization of the melt droplets; and performing a quenching process to cool the melt droplets by means of a cooling medium, wherein the quenching process is performed by a cyclonic device immediately adjacent to the wire tips such that each melt droplet is rapidly solidified to form the metal powder, wherein the metal powder is spherical, has an average diameter of 1~500 μm, and comprises a plurality of nano-grains.

2. The method according to claim 1, wherein the atomizing device atomizes the metal melt through a pressurized inert gas.

3. The method according to claim 2, wherein the inert gas is He (helium) or Ar (argon).

4. The method according to claim 2, wherein the pressure of the inert gas is 15~75 psi.

5. The method according to claim 1, wherein the cooling medium is a cool inert gas.

6. The method according to claim 1, wherein the cooling medium is liquid nitrogen.

7. The method according to claim 1, wherein the cooling medium is cool water.

8. A method of fabricating Pd (palladium) powders, comprising the steps of:

using two Pd wires as feedstock and electrodes;

performing a twin-Pd wire electric arc process to melt the Pd wire tips to form a Pd metal melt, and simultaneously, breaking the Pd metal melt into Pd melt droplets by an atomizing device; and performing a quenching process to cool the melt droplets by means of a cooling medium;

wherein a diameter of each Pd wire is about 1.5 mm;

wherein operating conditions of the electric arc process are 30 DC Voltage and 120 Ampere;

wherein the atomizing device atomizes the metal melt through an inert gas under pressure of about 20 psi.

* * * * *